US006315129B1

(12) United States Patent
Graney

(10) Patent No.: US 6,315,129 B1
(45) Date of Patent: Nov. 13, 2001

(54) POWER SIFTER

(76) Inventor: Francis Xavier Graney, 50 Vale St., Tewksbury, MA (US) 01876

( * ) Notice: Subject to any disclaimer, the term of this patent is extended or adjusted under 35 U.S.C. 154(b) by 0 days.

(21) Appl. No.: 08/943,946

(22) Filed: Aug. 28, 1997

(51) Int. Cl.[7] ..... B07B 1/49; E02F 1/00

(52) U.S. Cl. ..... 209/421; 209/235; 37/304; 37/904

(58) Field of Search ..... 209/235, 240, 209/241, 247, 255, 420, 421; 37/264, 265, 304, 904

(56) References Cited

U.S. PATENT DOCUMENTS 3,316,025 * 4/1967 Sullivan et al. ..... 209/421 X
4,633,602 * 1/1987 Layh et al. ..... 209/421 X
5,197,211 * 3/1993 Haug ..... 209/235 X

FOREIGN PATENT DOCUMENTS

2447423 * 9/1980 (FR) ..... 209/421
2228032 * 8/1990 (GB) ..... 209/421

* cited by examiner

*Primary Examiner*—Tuan N. Nguyen
(74) *Attorney, Agent, or Firm*—Benway & Harrington

(57) ABSTRACT

Method and apparatus of continuously sifting pre-tilled topsoil to a controlled depth in place to remove stone, weed, grass and other materials and separate the stone and heavy materials from vegetation which is compressed into bundles.

2 Claims, 2 Drawing Sheets

POWER SIFTER

BACKGROUND OF THE INVENTION

There is very little available to a homeowner or gardener to help him do a most difficult physical task—sift the soil before planting. There are many rototiller devices available and there are many people available to do rototilling as a service for individuals; however, once the soil is tilled the backbreaking work begins. There is very little available to accomplish shifting the soil to clean it of debris before replanting. What one normally has to do is rake the tilled soil pulling out the large rocks and stones one by one and shaking the clumps of grass to remove the topsoil and then releveling the ground and raking it until it is smooth and uniform, seeding, rolling it to plant grass or rows of vegetables follows. This invention does the work between tilling and planting. Another common practice after an area is tilled is to scrape off the topsoil and manually sift it and return it to where it was removed, relevel and then seed. Both practices are backbreaking work. The latter is, of course, the most useful.

The present invention solves the problem of removing, sifting and releveling the soil once tilled by having a self-propelled power-driven vibrating sifting device which penetrates the soil to controlled depths as it passes over the garden, removes the stone and other debris from the soil and redeposits the sifted soil below the device and carries the debris to one end of the yard for later removal. More than one pass may be needed in heavily weeded rocky soil, but the soil is never moved any distance saving a lot of effort.

The soil is sifted in place such that minimal leveling is required after the soil has been sifted, evenly with more than one pass. Piles of debris, rock, weeds and other clumps of soil are screened out and left to be picked up by a truck at one end of the garden.

Having established the need for a power sifter, several obstacles were presented. The first was guiding the device in a straight direction while sifting the soil. It was discovered that a vibrator that sifted left to right in equal and opposite directions balanced the turning or twisting torque on the sifter and did not pull the device either to the left or right and went straight ahead in perfect control.

It was also quickly discovered that the screens filled up too soon in many cases. A plow type configuration was best found because when it filled up the sifting could be stopped and the sifter lifted out of the soil and pushed to the end of the row, emptied and pulled back where sifting commenced once again. A device that was pulled in back of a tractor filled too quickly, not easily emptied where wanted and not easily controlled.

A sifter must be propelled by a gasoline motor. However, it was discovered that a hydrostatic motor was essential to control the operation smoothly, consistently and uniformly. The vibration can be provided by a power "take off" from the gas engine while a hydrostatic motor powers the wheels to propel the sifter along.

At first, tines were thought necessary to dig and rake into the ground. However, it was discovered selected steel mesh of about a one-half inch grid welded to a frame with a sharp bending edge was perfectly satisfactory. Finer sifting is controlled by selecting a finer mesh. An optimum mesh was found to be one-half inch or slightly larger.

There are many prior art devices that have been developed to power rake or dethatch an area. These devices remove some rocks and/or the thatch so that grass will grow better.

Neither of these devices actually sift the soil. There comes a time when one must remove all the big stones and growing roots, brush and grass, as well as weeds. This is when a power sifter is needed.

Therefore, an object of the present invention is to sift soil in place to remove unwanted rocks and other debris without moving the soil from its place in the garden.

Another object of the present invention is to be able to make several passes at the soil to controlled depths to remove debris, stone and unwanted vegetation with several passes in order to produce a topsoil clean to the satisfaction of the operator and/or needs of the gardener.

Another object of the present invention is to be able to control sifting independent of the movement of the device over a garden.

Another object of the present invention is to separate the stones from the vegetation.

Another object of the present invention is to boil the vegetation material into compact bundles.

BRIEF DESCRIPTION OF THE DRAWINGS

Other objects, features and advantages of the present invention will be better understood when read in conjunction with the attached specification in which.

BRIEF DESCRIPTION OF THE PREFERRED EMBODIMENT

Figure 1:
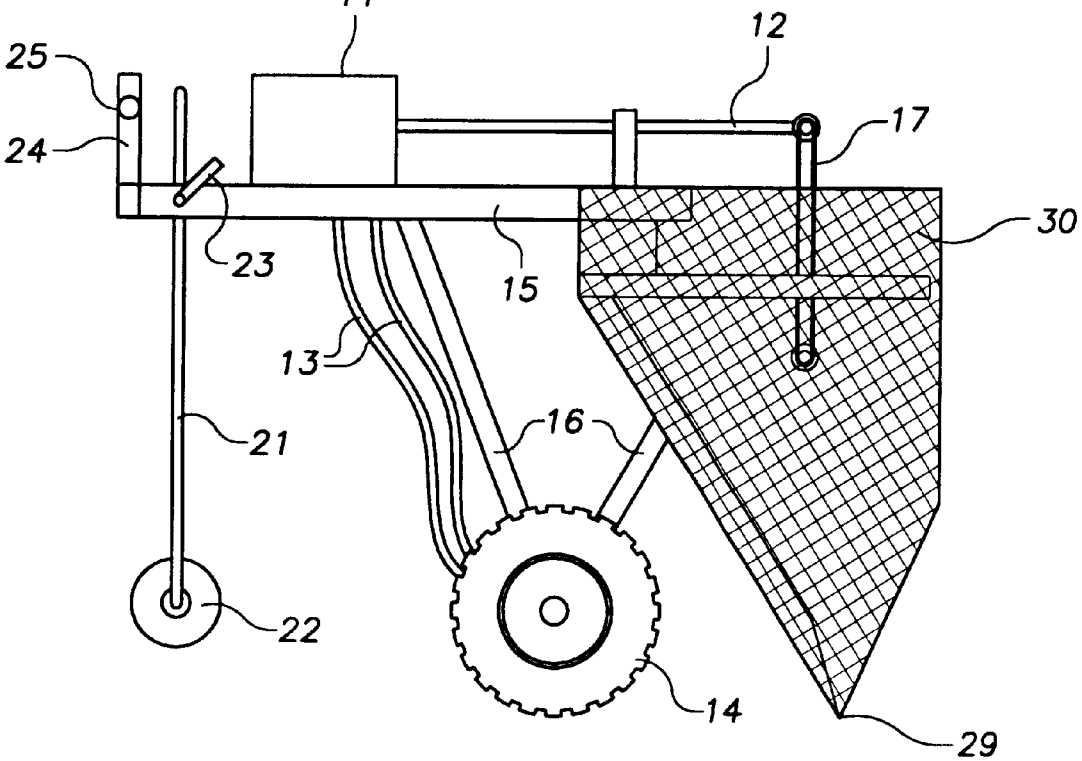
FIG. 1 is a side view of the present invention.

Referring now to FIG. 1, we see a side view of the present invention. The frame 15 is mounted on wheels through struts 16 and wheel 14. Wheel 14 has a tire on it approximately 10 inches in diameter with a heavy tread on it to propel the device through the soil. Hoses 13 from the hydraulic box, and motor 11 are the driving force to the wheel. This is where the hydrostatic motor force is needed. The hydrostatic motor provides a uniform torque to the driving wheel 14 which is separated by about four feet. The operator of the handles 25 causes forward rotation to be delivered to the wheels from the hydrostatic motor to cause them to turn as needed with a strong torque. Static wheel 22 is small on shaft 21 which is controlled in height by lever 23. The thrust of the basket blade 29 is controlled in the amount of depth in the ground that it is taking. Balance of the device is also provided by wheeled shaft 21 such that it sits when idle on the ground and does not fall one way or the other and can be moved around easily. Hydraulic box and motor 11, the hydrostatic portion of it, controls the wheels. A direct shaft 12 is taken off the gasoline engine that powers the hydrostatic motor to drive the belt 17 which provides the vibrating or sifting motion in the basket.

Figure 2:
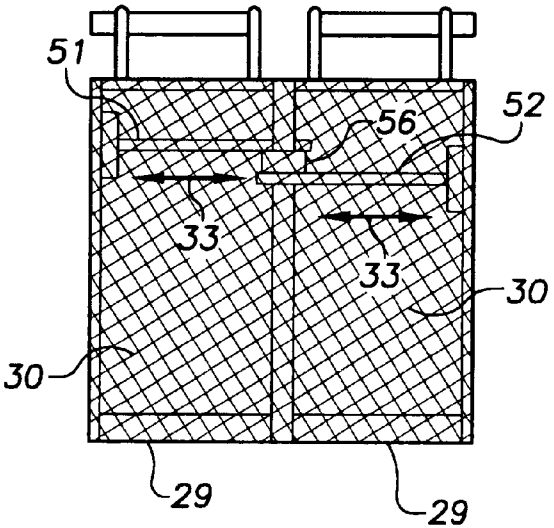
FIG. 2 is a top view of the two halves of the sifting basket.

Referring now to FIG. 2, we see a top view of the basket and the two front blades 29 which go into the soil. Mesh 30 is welded onto the entire frame. The frame basket is divided into two parts, the left hand side and the right hand side. The arrows 33 show the direction of the movement of the basket vibrators 51 and 52. The vibrator controlled by the belt 56 causes the bottom part of the baskets to move left and right in a synchronous manner such that no unwanted torque is put onto the basket to turn or move it out of control in an unwanted direction. To turn the device, the operator must pull on one handle 25 and push on the other.

Figure 3:
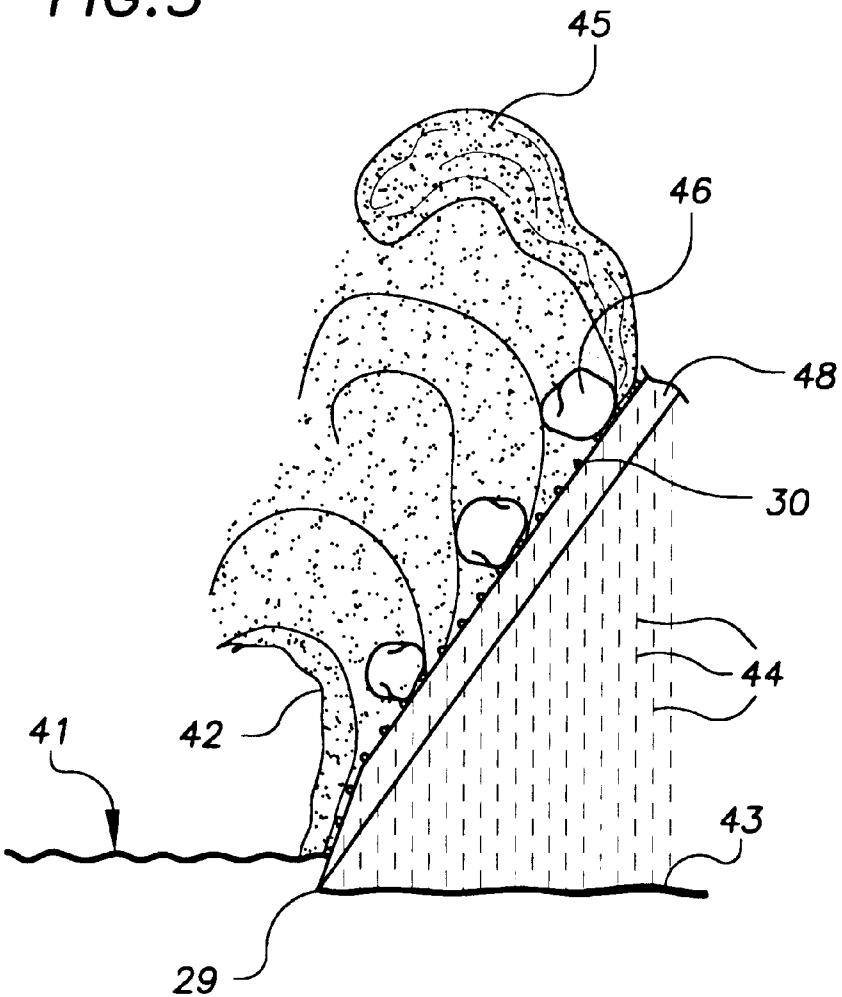
FIG. 3 is a side view of the sifting basket "blade" with a full load of sifted soil.

Referring now to FIG. 3, we see a side view of the sifting blades. Unsifted soil 41 is picked up by blade 29. The sifted soil 43 has passed through blade 29 and falls to the ground. A mesh 30 is welded onto the blade frame 48. The top soil 41 curls up as it is shown in the diagram on the mesh which is vibrating back and forth. Rocks 46, grass, thatch, weeds and roots being too large to go through the mesh 30, continue to gather in the basket. Sifted soil 44 continues to drop through the mesh and lands on the ground.

The operator walks behind the device holding onto the handles 25 on either side to control the hydrostatic power to the wheels and the angle and position of the blades 29. He walks along the field sifting the top soil in a slow continuous manner. When he has filled the basket, he stops propelling the device, lifts the blades 29 from the soil and he pushes the full basket to the end of the yard and empties it there and restarts where he had stopped sifting to begin again until the entire yard has about an inch of clear top soil sifted with all the debris piled up along, one side of the field or garden. Another vehicle or truck is used to remove the accumulated debris, rocks, thatch, grass, weeds and roots that have been sifted out of the soil to some other location for disposal.

Figure 4:
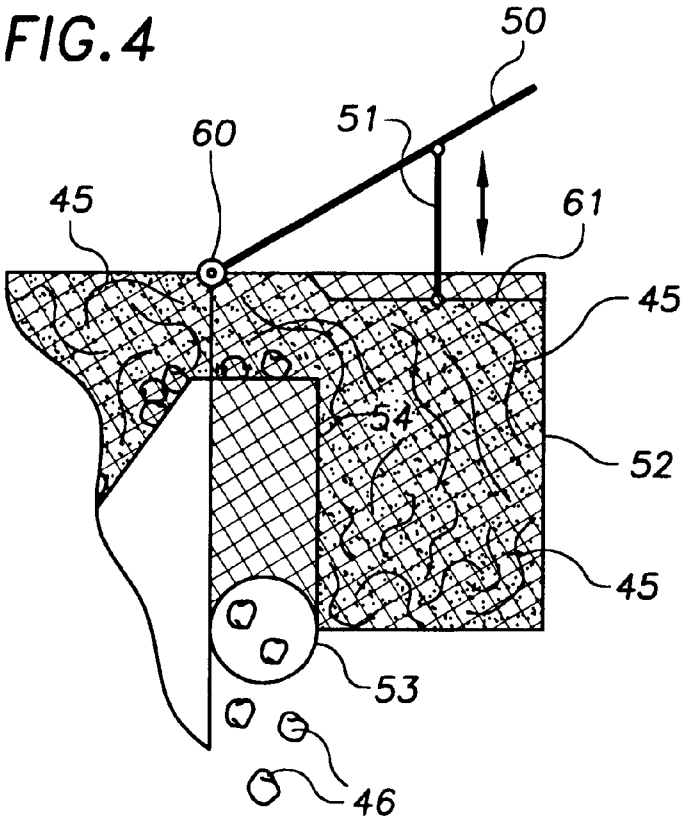
FIG. 4 is a side view of an added chamber where the stone is separated from the vegetation.

To speed up the process and make it continuous, another chamber is added to the basket as shown in FIG. 4. It is divided into two parts. The first part has a tubular shape that diverts all heavy stones and solid objects down to the left of the device behind its left wheel.

The second part of the added chamber receives the lighter material—grass, weeds, roots and clumps of vegetation. When the chamber 52 starts to fill, a lever 50 is pressed to push plate 61 down to compress these weeds to form a bale 45. The compression is repeated several times until a bale 45 is formed that is relatively dense. The panels of the basket are opened and the bale falls out to the right of the device for later removal.

The stones and heavy material are later collected and used as solid fill for various garden projects. The bales are collected and placed in the compost heap for decomposition and reuse or burned because of the presence of weeds and unwanted seeds.

The soil now has been fully sifted, just as if the individual had removed the soil and put it through a sifter and returned it back to the garden, spread it out, smoothed it, rolled it and then planted it. With the present invention, the soil is sifted right in place and the user merely has to lightly rake it, put his seed in the soil, roll it and then water it until the grass grows or the rows of vegetables appear. The obvious advantage of the present invention is to provide a solid base of sifted soil as effortlessly as possible with the use of machinery to accomplish the task. It also enables one to clean up the yard to prepare it ready for planting of crops, if that is the intended use of the yard.

It is seen that the product is the combination of many available off-the-shelf items. The gasoline motor is purchased from many manufacturers, as well as the hydrostatic motor. To drive the wheels the hydrostatic motor can be easily and smoothly operated. Although I have described my invention with reference to specific apparatus, I wish not to be limited thereby but only by the appending claims.

What is claimed is:

1. A soil sifter comprising, a self propelled wheeled frame which includes a gasoline engine with a hydrostatic drive coupled to the wheels, adjustable means for removing the top level of soil to a controllable depth, screen means for separating and accumulating rocks, roots, soil-less sods from the top soil, permitting the sifted top soil to return to the ground surface, said screen means having vibrating means for shaking preselected portions of said screen means in equal and opposite directions, means for separating stones and heavy debris from said soil, means for releasing stones and heavy objects to the perimeter of a garden in a steady stream, and means for compacting vegetation materials.

2. A method of sifting topsoil comprising the steps of, tilling the topsoil to break up the surface, scraping a preselected depth of topsoil onto a screen, vibrating said screen left and right to permit soil to pass through the screen to return to the ground, collecting rocks, grass sods and debris from the topsoil, forming the screens into two halves, and vibrating said halves in equal and opposite directions, propelling said soil sifting screens in rows over the entire garden surface, separating stones and heavy objects from the vegetation and placing them along the edge of each row, compacting the vegetation into bales for later removal.

* * * * *